US005237338A

United States Patent [19]

Stephenson

[11] Patent Number: 5,237,338

[45] Date of Patent: Aug. 17, 1993

[54] IS-ENTHALPIC CONTROL OF A THERMAL PRINTING HEAD

[75] Inventor: Stanley W. Stephenson, Spencerport, N.Y.

[73] Assignee: Eastman Kodak Company, Rochester, N.Y.

[21] Appl. No.: 740,552

[22] Filed: Aug. 5, 1991

[51] Int. Cl.[5] ..... B41J 2/365

[52] U.S. Cl. ..... 346/76 PH; 236/49.3; 374/40; 374/41; 165/40

[58] Field of Search ..... 346/76 PH; 236/49.3; 374/40, 41; 165/40

[56] References Cited

U.S. PATENT DOCUMENTS

| | | | |
|---|---|---|---|
| 4,126,269 | 11/1978 | Bruges | 236/49 |
| 4,648,551 | 3/1987 | Thompson et al. | 236/49 |
| 4,659,290 | 4/1987 | Kundert | 417/32 |
| 4,722,669 | 2/1988 | Kundert | 417/32 |
| 4,745,413 | 5/1988 | Brownstein et al. | 346/76 |
| 4,773,023 | 9/1988 | Giardina | 374/41 |
| 4,797,837 | 1/1989 | Brooks | 364/519 |
| 5,095,333 | 3/1992 | Shimada | 236/49.3 |
| 5,102,040 | 4/1992 | Harvey | 236/49.3 |

FOREIGN PATENT DOCUMENTS

| | | | |
|---|---|---|---|
| 2615858 | 10/1977 | Fed. Rep. of Germany | 374/41 |
| 2931905 | 12/1980 | Fed. Rep. of Germany | 374/41 |
| 3208511 | 9/1983 | Fed. Rep. of Germany | 374/41 |
| 0063728 | 5/1980 | Japan | 374/41 |

*Primary Examiner*—Benjamin R. Fuller
*Assistant Examiner*—Huan Tran
*Attorney, Agent, or Firm*—Kevin A. Sembrat; Raymond L. Owens

[57] ABSTRACT

Is-enthalpic temperature control of the operation of the thermal printing head of a thermal printing device is attained by use of a transfer area at the head to transfer heat from the head to a coolant fluid moved by a fluid mover across the transfer area at a flow rate controlled by a circuit on the basis of a sensor that measures the flow rate of electrical energy being fed to the head, and sensors that sense the mass flow rate of the fluid and its rise in temperature upon flow across the transfer area for determining the flow rate of energy being removed from the head. The circuit controls the fluid mover to adjust the fluid flow rate so that the net energy in the head remains substantially constant.

19 Claims, 2 Drawing Sheets

IS-ENTHALPIC CONTROL OF A THERMAL PRINTING HEAD

FIELD OF THE INVENTION

This invention relates to apparatus and method for controlling the temperature of a device that generates heat during operation, and more particularly to is-enthalpic control of a thermal printing head.

As used herein, the term "is-enthalpic" is defined as constant enthalpy, i.e., a system evidencing no change in enthalpy, or one which is iso-enthalpic. Enthalpy is defined as a thermodynamic function of a system, equivalent to the internal energy plus the product of the pressure and the volume. Enthalpy is the same as the heat content of the system.

BACKGROUND OF THE INVENTION

Techniques are known for controlling the operating temperature of devices that generate heat during operation and require cooling to keep their temperature below a threshold limit. Examples of systems employed for attaining this end are shown in the following prior art.

U.S. Pat. No. 4,126,269 (Bruges) discloses a series of fans spaced along a flow path in a ventilated housing which cools electronic devices therein with a flow of filtered air. Each fan has a temperature sensor for emitting a signal when a temperature threshold limit is reached, so indicating inadequate cooling due to a clogged filter or the stopping or reduction in speed of the fan.

U.S. Pat. No. 4,648,551 (Thompson et al.) discloses a blower motor system for an indirect heat exchange flow, fuel gas/air furnace, that adjusts the fuel gas feed and the pressure delivery fan for intake air to be preheated by heat exchange with an already combusted fuel gas/air mixture. After condensing water from the heat exchanged combusted mixture, the latter is removed under suction fan operation. Flow adjustments are made, e.g., to compensate for flow variation due to dirty filters, closed ducts, reduced line voltage and increased motor temperature, so as to maintain appropriate air delivery for a specified air temperature rise in the system. The adjustments are controlled by pressure sensors for the combusted mixture and intake air, respectively, in the heat exchanger, and a temperature sensor for the preheated air to effect its precooling in a separate unit if excessively preheated in the heat exchanger prior to combustion.

U.S. Pat. No. 4,659,290 (Kundert) discloses a fan for cooling electronic components with a main air flow, which has a speed controller whose circuit is in a chamber on the fan hub through which a minor air flow, representative of the main air flow, passes for sensing by a temperature sensor. The fan is adjusted as a function of the air temperature relative to a threshold limit, to increase its speed above a minimum when the air temperature exceeds the limit, and to return it to minimum speed when the temperature returns below the limit. An alarm system signals overheating, e.g., due to a clogged filter, even if the fan functions normally.

U.S. Pat. No. 4,722,669 (Kundert) discloses a speed controller for a fan that cools electronic devices, in which an exhaust air temperature sensor controls the fan speed to keep the devices at a constant temperature over a range of varying inlet air temperatures. Thus, fan speed is adjusted relative to changes in inlet air temperature as sensed by the exhaust air temperature.

In certain thermal printers, an array of thermal print head elements is disposed to drive dyes from a dye-bearing web into a dye receiving sheet. In others, resistive elements of the print head are selectively energized to create images directly on thermally sensitive media. In these units, only a small portion of the energy fed to the elements generates the images, the major energy portion remaining in the thermal head which functions as a heat sink. This excess energy stored in the head raises its temperature, so that the effective image density increases with increasing head temperature. Often, the unit has cooling means such as a fan to remove excess heat from the head. It is known that print quality improves if the head is kept at a temperature higher than ambient.

Typically, during the line printing time for printing each line of images, the thermal print head elements are selectively energized by constant current pulses of predetermined time duration or pulse width. A control circuit generates enable signals of selective time duration which are used to vary or modulate the pulse width of the energizing current. In this way, the heating elements are energized with an enable width corresponding to the selective time duration of the enable signals during the line printing time, for controlled printing of the images. The heat generated in the head increases with increase in the proportion that the enable time (power energizing time) bears to the line printing time.

A variety of means has been used to sense the power delivered to the thermal head. Other sensing means have been disclosed to monitor the head temperature. These sensors are typically connected to electrical control systems that modulate the enable width of the element energizing current, the head voltage, or a cooling fan or other cooling means, in an effort to assure that the resulting print density remains constant.

U.S. Pat. No. 4,797,837 (Brooks) discloses controlling a thermoelectric heat pump to cool intermittently the thermal head of a thermal printing device having a plurality of heating elements that generate images on a responsive imaging material. The head temperature is sensed and compared with a reference temperature to determine if heat pump operation should be initiated or halted.

Commonly assigned U.S. Pat. Nos. 4,745,413 (Brownstein et al.) and 4,912,486 (Yumino), disclose typical thermal printing devices having a thermal printing head with a plurality of heating elements used to generate images on a responsive imaging material.

In all these systems, uneven heating and abrupt changes in delivered power can cause the associated temperature sensors to operate sub-optimally.

These known arrangements use complicated and costly means to attain temperature control or lack adequate means for such control.

It is desirable to have a thermal printing device with is-enthalpic control and a method of operating such a device under is-enthalpic control, to cool its printing head so that the net energy in the head remains substantially constant, independently of cooling effect changes caused by changes in ambient cooling fluid, such as air temperature, humidity and barometric pressure changes, or filter clogging.

SUMMARY OF THE INVENTION

The foregoing limitations have been effectively obviated by providing a thermal printing device with is-enthalpic control. Additionally, a method is provided for operating such a device under is-enthalpic control to cool its printing head so that the net energy therein remains substantially constant. The described system is relatively immune to changes in cooling effect caused by changes in ambient cooling fluid, such as air temperature, humidity and barometric pressure changes, filter clogging, or the like. The described method is immune to temporary temperature gradients within the heat sink, i.e., within the thermal printing head.

Briefly, thermal printing head temperature control is achieved with a system using means such as a shunt resistor in the power line to the head to measure the amount of electrical energy that is being delivered to the head, and additional means such as a solid state mass flow sensor and intake and exhaust temperature sensors to determine the amount of thermal energy that is being removed from the head by a fluid heat transfer medium cooling system, at any point in time. The cooling system, such as a fan for a gaseous medium, e.g., air, or a pump for a liquid medium, e.g., water, is controlled so that the heat energy removed thereby is substantially equivalent to the heat energy being delivered to the head, so as to maintain a constant enthalpy within the head.

In effect, upon measuring the energy being fed to the head, and the mass flow rate of the cooling fluid and its temperature rise consequent cooling use, on an instantaneous basis, these measurements are applied on the same basis to adjust the cooling fluid flow rate so that the net energy added to the head is substantially zero at any point in time. The key here is measuring the power or heat energy into, and the power or heat energy out of, the system for adjusting the cooling fluid flow to achieve is-enthalpic control of the head.

As a result, the average temperature of the head is maintained more constant than otherwise under a variety of printing and ambient conditions. The system is immune to temporary temperature gradients arising in the head as heat sink. This uniformity of average temperature in the head reduces density variation in the images printed thereby. It is to be noted that at constant enthalpy or is-enthalpy, there may be different temperatures distributed locally throughout the head, which functions as a heat sink. However, in accordance with the present invention, the average temperature of the head always remains constant.

The thermal printing device comprises a thermal printing head energizable by a selective flow of electrical energy to generate images on a responsive imaging material, a heat transfer area associated with the head and disposed to effect transfer of heat generated by the head to a fluid heat transfer medium, controllable moving means for moving the medium at a controllable flow rate to flow across the transfer area to remove therefrom heat generated by the head, measuring means, determining means and control means.

The measuring means measure the flow rate of electrical energy to the head, the determining means determine the flow rate of heat energy removed from the head by the medium that flows across the transfer area, and the control means control the moving means, in dependence upon the measured flow rate of energy to the head, and the determined flow rate of energy removed from the head by the medium, to adjust the flow rate of the medium so that the net energy in the head remains substantially constant.

Typically, the head has a plurality of elements energizable to generate the images on the responsive material, and the transfer area is a coolable portion on the head remote from the elements and capable of being cooled by flow contact with the medium.

The determining means may comprise flow sensing means to sense the mass flow rate of the medium that flows across the transfer area, and temperature sensing means to sense the change in temperature of the medium upon flow across the transfer area, with the control means arranged to control the moving means, in dependence upon the measured flow rate of energy to the head, and the sensed mass flow rate and sensed change in temperature of the medium, to effect such medium flow rate adjustment.

The temperature sensing means may include an intake temperature sensor disposed to sense the temperature of the medium prior to flow across the transfer area, and an exhaust temperature sensor disposed to sense the temperature of the medium after flow thereacross, to sense and thus determine the change in temperature.

Typically, the flow sensing means are disposed to sense the mass flow rate of the medium at a point prior to its flow across the transfer area. However, it is to be understood that the flow sensing means may be positioned anywhere along the cooling fluid path. The flow sensing means may be mass flow measuring means to measure the mass per unit time of a gaseous heat transfer medium such as air, and the moving means may be a fan. Alternatively, the flow sensing means may be mass flow measuring means to measure the mass per unit time of a liquid heat transfer medium such as water, and the moving means may be a pump.

The device may optionally comprise auxiliary measuring means to measure cumulatively the energy flow into and that being removed from the head over a selective on-going period of time. In this case, the control means is arranged to control the moving means to adjust the flow rate of the medium, in further dependence upon the measured cumulative energy flow into and that being removed from the head, so as to compensate for temporary imbalances in which the energy flow into the head exceeds that being removed therefrom.

Also, the device may optionally comprise auxiliary temperature sensing means to sense the temperature of the head. In this case, the control means is arranged either to control the moving means to adjust the flow rate of the medium, or to control the flow of energy to the head, in further dependence upon the sensed head temperature, so as to maintain the head at a selective elevated temperature above ambient temperature.

The method of operating the thermal printing device under is-enthalpic control, comprises delivering a selective flow of electrical energy to the printing head to generate the images, the head being provided with such transfer area associated therewith to effect transfer of heat generated by the head to the fluid heat transfer medium, moving a flow of the medium across the transfer area to remove therefrom heat generated by the head, measuring the flow rate of electrical energy to the head, determining the flow rate of heat energy removed from the head by the medium, and controlling the moving of the medium.

The control of the moving of the medium is effected in dependence upon the measured flow rate of energy to the head and the determined flow rate of energy removed therefrom by the medium, to adjust the medium flow rate so that the net energy in the head remains substantially constant.

The determining of the flow rate of heat energy removed from the head may comprise sensing the mass flow rate of the medium that flows across the transfer area, sensing its temperature prior to and after flow across the transfer area, and in turn its temperature change upon flow across such area, and controlling the moving of the medium, in dependence upon the measured flow rate of energy to the head, and the sensed mass flow rate and sensed change in temperature of the medium, to effect such medium flow rate adjustment.

The method may optionally comprise measuring cumulatively the energy flow into and that being removed from the head over a selective on-going period of time, and controlling the moving of the medium to adjust its flow rate, in further dependence upon the measured cumulative energy flow into and that being removed from the head, so as to compensate for temporary imbalances in which the energy flow into the head exceeds that being removed therefrom.

Also, the method may optionally comprise sensing the temperature of the head, and either controlling the moving of the medium to adjust its flow rate, or controlling the energy flow to the head, in further dependence upon the sensed head temperature, so as to maintain the head at a selective elevated temperature above ambient temperature.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
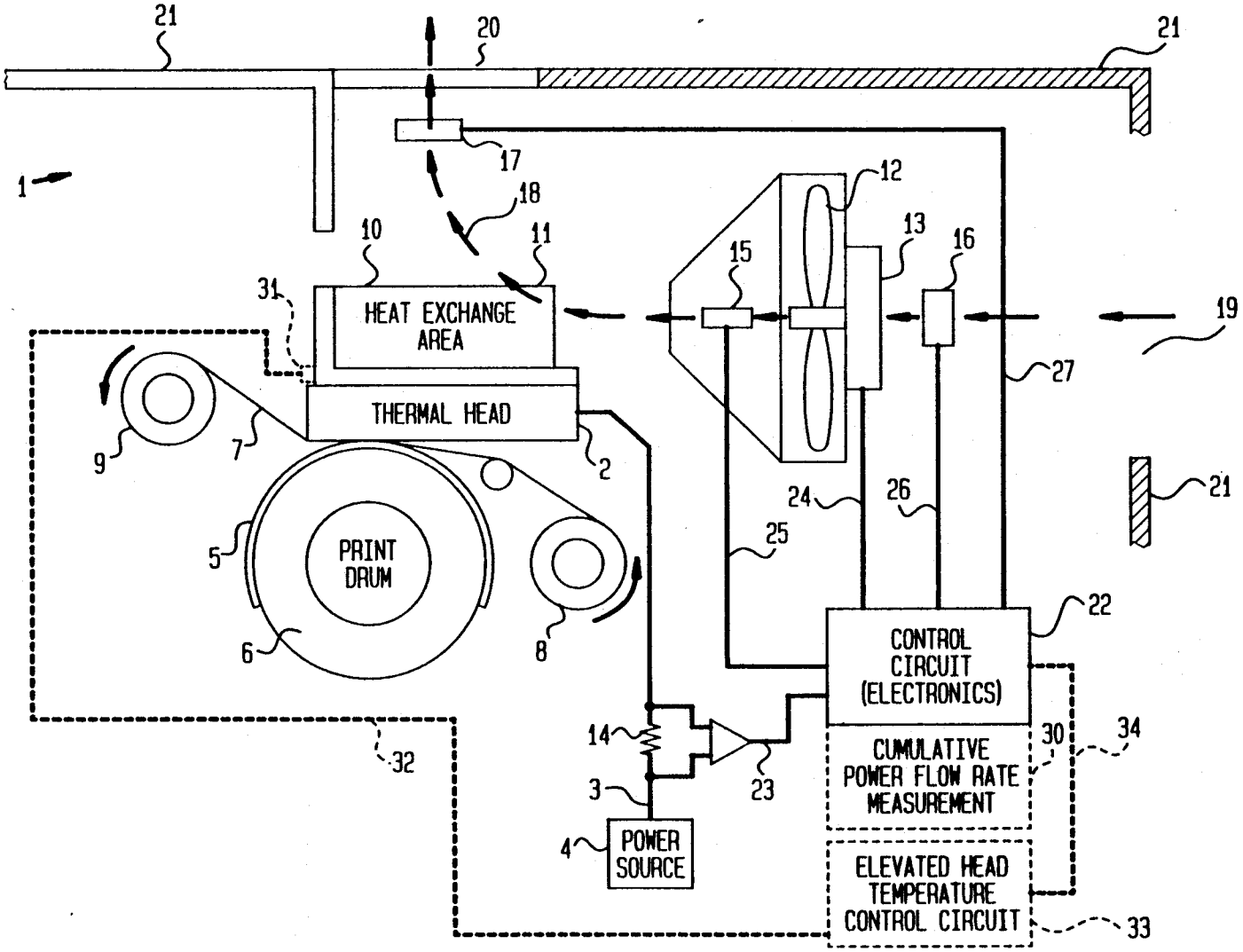
FIG. 1 is a schematic view of a thermal printing device having is-enthalpic control, in accordance with one embodiment of the invention.

Referring now to FIG. 1, there is shown a thermal printing device 1 in accordance with one embodiment of the invention The thermal printing device 1, which uses a gaseous heat transfer medium formed of ambient air as fluid coolant, comprises a thermal printing head 2, a power line 3, a power source 4, a paper sheet 5, a print drum 6, a web carrier 7, donor payout and take-up rolls 8 and 9, a heat transfer area 10, fins 11, a fan 12, a fan drive or motor 13, a head power sensor 14, a flow sensor 15, temperature sensors 16 and 17, a flow path 18, intake and exhaust regions 19 and 20, a housing 21, control means 22, a head power sense line 23, a fan power line 24, a flow sense line 25, intake temperature sense and exhaust temperature sense lines 26 and 27, a cumulative power flow rate measurement circuit 30, a head temperature sensor 31, an auxiliary head temperature sense line 32, an elevated head temperature control circuit 33, and an auxiliary control line 34.

Device 1 comprises a conventional stationary thermal printing head 2 (such as is disclosed in said commonly assigned U.S. Patent No. 4,745,413 to Brownstein et al.), receiving power via power line 3 from power source 4. Head 2 has a plurality of elements (not shown) that are energized by a selective flow of electrical energy to generate images on a responsive imaging material, such as paper sheet 5 mounted on rotatable print drum 6 by heat transfer of thermally diffusible dye located on web carrier 7, fed from donor payout roll 8 and received on donor take-up roll 9. As print roll 7 and donor rolls 8,9 rotate, while head 2 remains fixed, sheet 5 and dye carrier 7 travel together in the nip between head 2 and print drum 6 to effect the required thermal printing of the images or image data in a given cycle.

During printing, head 2 generates heat that must be removed in order to maintain its temperature at a desired level for optimum quality printing. The more uniform the operating temperature of head 2, the more uniform the print density of the generated images, i.e., use of a uniform temperature reduces the density variation in the print images within each cycle and in successive cycles.

In accordance with the invention, to achieve such uniformity, heat transfer area 10, formed as a heat exchange area such as a series of cooling fins 11, is associated with head 2, e.g., disposed at the back of head 2 remote from its printing elements, to effect transfer of heat generated by head 2 to the air. Area 10 forms a coolable portion on head 2 remote from its printing elements and capable of being cooled by flow contact with the air. Controllable moving means such as fan 12 with conventional fan drive or motor 13 move the air at a controllable flow rate to flow across area 10 to remove from it heat generated by head 2.

Also provided are measuring means such as head power sensor 14 to measure the electrical energy flow rate to head 2, and determining means, for instance, the combination of flow sensing means, such as flow sensor 15 to sense the mass flow rate of the air, with temperature sensing means to sense and thus determine the change in temperature of the air upon flow across area 10, such as intake temperature sensor 16 and exhaust temperature sensor 17. Sensors 15, 16 and 17 together determine the flow rate of heat energy removed from head 2 by the air that flows across area 10 in flow path 18 (indicated by the arrows in FIG. 1) between air intake region 19 and air exhaust region 20 of housing 21 that encloses the adjacent portion of device 1.

Flow sensor 15 is disposed in path 18 to sense the mass flow rate of the air, e.g., at a point prior to its flow across area 10. Temperature sensor 16 is disposed in path 18 to sense the temperature of the air prior to its flow across area 10 and temperature sensor 17 is disposed in path 18 to sense the temperature of the air after flow across area 10, for sensing and thereby determining the change in air temperature between intake region 19 and exhaust region 20.

Control means 22, such as a microprocessor, has a conventional electronic control circuit programmed to control the operation of head 2 and fan 12 in conjunction with head power sensor 14, fan motor 13, flow sensor 15 and temperature sensors 16,17. Control means 22 is connected to head power sensor 14 by head power sense line 23, to fan motor 13 by fan power line 24, to flow sensor 15 by flow sense line 25, and to intake and exhaust temperature sensors 16 and 17 by intake and exhaust temperature sense lines 26 and 27, respectively.

Control means 22 controls the speed of fan 12 by controlling the voltage across fan motor 13, in dependence upon the measured flow rate of energy to head 2, and the determined flow rate of energy removed therefrom by the air, to adjust the air flow rate so that the net energy in head 2 remains substantially constant. While different temperatures may actually be distributed locally throughout head 2 as heat sink at any given time, the average temperature of head 2 always remains constant at the constant enthalpy achieved by the control system of the invention.

The amount of heat removed from head 2 by the air flow can be determined in known manner by the following equation:

$$Qout = Cp \times Mass \times (Tout - Tin)$$

where Qout is the heat energy exhausted by the fluid heat transfer medium (removed by the air flow), Cp is the heat capacity or specific heat of the medium (a constant roughly equivalent to the enthalpy of air or other fluid used), Mass is the mass of exhausted medium (air), as determined by flow sensor 15, Tout is the temperature of the medium (air) leaving the heat exchange area (area 10), as determined by exhaust temperature sensor 17, and Tin is the temperature of the medium (air) entering the heat exchange area, as determined by intake temperature sensor 16.

Thus, the heat energy removed from head 2 is the product of the cooling fluid heat capacity times the mass of the fluid times its temperature rise increment upon flow across area 10.

Fan motor 13 may be of conventional design, having a speed responsive to an applied voltage, for infinitely varying the fan speed and thus the air flow rate.

Head power sensor 14 may be a conventional measuring device to measure the instantaneous power flowing to head 2, such as a shunt resistor, e.g., having a value of 0.001 ohms, placed in the power feed line to or return line from head 2. The voltage drop across the resistor serves as a measure of the power being fed to head 2. In another embodiment, the head power sensor may comprise an inductively coupled current transformer and conditioning electronics of conventional design (not shown), arranged so as to measure the power being fed to head 2.

Intake and exhaust temperature sensors 16 and 17 may each be a conventional fluid temperature sensor. In one embodiment, the temperature sensor may be a conventional thermocouple of fine gage wire to achieve maximum sensitivity. In another embodiment, the temperature sensor may be a fast time response thermistor head, also of conventional design.

Flow sensor 15 may be a conventional mass flow sensor, such as a solid state sensor, e.g., that available as MICRO SWITCH part number X80961-A (Micro Switch Division, Honeywell, Inc., Minneapolis, Minn.), having a heater element with a resistor, and a temperature sensor, such as an RTD (resistance temperature device), or a thermistor, on a ceramic plate or chip, plus a feedback control circuit that senses the chip temperature and adjusts the power to the resistor of the heater element to maintain the temperature constant. By keeping the chip at a constant temperature above ambient, the power, e.g., current, flow to the chip is proportional to, and therefore, in conjunction with the temperature of the air flow, provides an accurate indication of, the mass flow rate of the air or other fluid heat transfer medium being sensed.

For example, as the flow of ambient temperature cooling fluid, e.g., air, across the chip increases, the power required to keep the chip at constant temperature above ambient temperature correspondingly increases, since the chip is being cooled by an increased cooling fluid flow. The feedback control circuit compensates for the sensed decrease in chip temperature by correspondingly increasing the power, e.g., current, to the heater element of the chip to keep the chip at its constant temperature. The instantaneous mass flow rate of the cooling fluid is determined by control means 22 by measuring the power delivered to the chip.

Flow sensor 15 and intake temperature sensor 16 sense and measure the mass flow rate and ambient temperature of the air upstream of area 10, while exhaust temperature sensor 17 senses and measures the rise in temperature of the air after heat exchange travel through area 10. In this way, the instantaneous amount of heat energy being removed from head 2 is determined and fed as information (signals) to control means 22. At the same time, the amount of power flowing to head 2 as sensed by head power sensor 14 which signifies the instantaneous amount of heat energy being supplied to head 2, is fed as information (signals) to control means 22. In response to this information, control means 22 controls fan 12, e.g. by varying the voltage supply to fan motor 13, to increase or decrease the amount of air across fins 11.

The voltage of fan 12, and therefore the air flow, is varied by control means 22 to adjust the system so that the input and output energies are kept substantially equal at any given point in time. This precisely controllable system is inherently immune to ambient condition effects that adversely occur using known control systems. Specifically, the system of the invention is immune to changes in cooling effects caused by changes in ambient (intake) air temperature, humidity and barometric pressure, filter clogging, and the like.

Despite such changes, precise operation of device 1 is achieved by way of the invention because it is the rise in temperature of the air and its mass flow rate that are measured to determine the heat energy removed from head 2 by the air flow, for use with the measured heat energy supplied to head 2, to adjust the speed of fan 12 to maintain constant the net energy to head 2. Changes in temperature, pressure or humidity of the ambient air that affect its density are inconsequential as fan speed is controlled herein per the above equation on the basis of the rise in temperature of the air taken with its mass flow rate which is independent of variation in cooling fluid density. Changes in ambient air flow rate, e.g., due to a clogged filter, merely change the flow rate information sent to control means 22, causing a compensating adjustment in fan speed for heat balance.

Specifically, it is the mass flow rate, e.g. in lbs of cooling fluid/unit time, that is measured by flow sensor 15, rather than the volume flow rate, e.g., in cu ft of cooling fluid/unit time. As the mass flow rate value is independent of density, and thus of changes in ambient temperature, barometric pressure, humidity content and other variables that affect density and in turn the volume flow rate measurement, a more precise instantaneous measure of the heat energy removed by the cooling fluid is attained in terms of its rise in temperature as sensed by intake and exhaust temperature sensors 16 and 17. This distinction enables device 1 to be used any place in the world without regard to variations in altitude and/or humidity as between sea level locations, e.g., New York City, N.Y., and mile high locations, e.g., Denver, CO.

In essence, head 2 is maintained at constant net energy level by measuring the difference between the instantaneous heat energy being fed thereto as sensed by head power sensor 14 and the instantaneous heat energy being removed therefrom by the cooling fluid, as sensed by flow sensor 15 in conjunction with temperature sensors I6 and 17. The precise, instantaneously responsive is-enthalpic control attained herein cannot be obtained on the basis of density dependent volume flow rate measurement nor by measuring the temperature of head 2 itself due to the time lag in manifesting changes in its temperature consequent its heat sink nature.

According to an optional feature, in the event that the maximum instantaneous cooling rate may not be able to match the cumulative maximum energy delivery rate to head 2 during on-going operation, additional means may be provided in the control circuit of control means 22 to measure the power flow to head 2 over time, i.e., over a cumulative time period The cooling system, e.g., fan 12, is then operated by control means 22 to respond to both the instantaneous or current energy input to head 2 and the previous energy imbalances as measured cumulatively by the additional means in the control circuit of control means 22.

To this end, device 1 may have auxiliary measuring means to measure cumulatively the energy flow into and that being removed from head 2 over a selective on-going period of time, such as a conventional cumulative power flow rate measurement circuit 30 (shown in dashed line in FIG. 1) in control means 22. In this case, control means 22 is programmed to control fan 12 via fan motor 13 to adjust the air flow rate in further dependence upon the measured cumulative energy flow into and that being removed from head 2, to compensate for temporary imbalances in which the energy flow into head 2 exceeds that being removed therefrom. Such measurement is based on the added energy flow rate sensed by head power sensor 14 and the removed energy flow rate sensed by the combination of flow sensor 15 and temperature sensors 16 and 17, over the selected cumulative period of time.

In typical thermal printers, print quality is often enhanced by raising the heat sink temperature a fixed level above ambient temperature. According to a further optional feature, device 1 may have such a temperature offset for head 2 to enhance print quality.

According to one form of this further optional feature, control means 22 is programmed to idle temporarily the cooling system, e.g., fan 12, at a lower cooling capacity initially to raise the temperature of head 2 to a selective fixed level above ambient temperature, such as by idling fan 12 at 10% cooling capacity. Control means 22 then operates fan 12 normally to keep head 2 at constant net energy at the raised temperature level.

According to another form of this optional feature, an auxiliary heating system is operated in conjunction with the main cooling system, e.g., fan 12, to keep head 2 at the fixed elevated temperature, such as an auxiliary heating circuit in control means 22 programmed to energize intermittently either head 2 per power line 3, or a conventional auxiliary heater in head 2, in response to a signal from a temperature sensor on the heat sink, i.e., mounted on head 2. This intermittent auxiliary heating will keep head 2 at the raised temperature level, while fan 12 operates normally to keep head 2 at constant net energy at that raised temperature level.

Due to the thermal inertia of the heat sink as constituted by head 2, the auxiliary heating circuit is not influenced by the dynamic servo control of the heat energy balance effected by the main cooling system, e.g., fan 12, in maintaining is-enthalpic control of the system. The auxiliary heating circuit operates in response to the time lag dependent sensed temperature of head 2, whereas the underlying is-enthalpic control system operates in response to measured instantaneous differences in the heat content of head 2 based on the heat energy fed to head 2 by power source 4 and that removed from head 2 at area 10 by the cooling air flow.

To this end, device 1 may have auxiliary temperature sensing means to sense the temperature of head 2 itself, such as a conventional elevated head temperature sensor 31 connected by an auxiliary head temperature sense line 32 to a conventional elevated head temperature control circuit 33 in turn connected by an auxiliary control line 34 to control means 22 (sensor 31, line 32, circuit 33 and line 34 being shown in dashed line in FIG. 1). In this case, control means 22 is programmed to control per circuit 33 either fan 12 via fan motor 13 to adjust the air flow rate, or the energy flow to head 2, in further dependence upon the sensed temperature of head 2, to maintain head 2 at a selective elevated temperature above ambient temperature.

In a typical known system, if the printer starts with maximum head power input, a heat sensor controlled unit will experience a delay until the heat sink has risen significantly in temperature. On the other hand, according to the invention, due to the is-enthalpic control, heat is removed immediately as energy is fed to head 2, allowing a fan 12 of sufficient capacity to remove the same amount of energy as that being delivered to the heating elements. If the ambient cooling air temperature or humidity changes, or if its flow is reduced due to a clogged filter, the cooling system of the invention simply adjusts the air flow a compensating amount to assure that the energy balance still remains constant.

In all cases, the is-enthalpic control system of the invention maintains head 2 at a more constant temperature than otherwise under a variety of printing and ambient conditions. As a result, the more uniform temperature of head 2 concordantly reduces density variation in the printed images.

Device 1 is thus operated by a method assuring is-enthalpic control of head 2, per the steps of delivering a selective flow of electrical energy to head 2 to generate the desired images on sheet 5, with area 10 effecting transfer of heat generated by head 2 to the air, moving a flow of air across area 10 to remove from it such generated heat, measuring the flow rate of electrical energy to head 2, determining the flow rate of heat energy removed from head 2 by the air, and controlling the moving of the air in dependence upon the measured flow rate of energy to head 2 and the determined flow rate of energy removed from it by the air, to adjust the air flow rate to keep substantially constant the net energy in head 2.

Determining the flow rate of heat energy removed from head 2 in particular comprises sensing the mass flow rate of the air that flows across area 10, sensing the air temperature prior to and after flow across area 10, and determining the change in air temperature upon flow thereacross, with the air movement being controlled in dependence upon the measured energy flow rate to head 2, and the sensed mass flow rate and sensed change in temperature of the air, to effect such air flow rate adjustment.

This method optionally contemplates measuring cumulatively the energy flow into and that being removed from head 2 over a selective on-going period of time, and controlling the moving of the air to adjust its flow rate, in further dependence upon the measured cumulative energy flow into and that being removed from head 2, to compensate for temporary imbalances in which the energy flow into head 2 exceeds that being removed from it.

It also optionally contemplates sensing the temperature of head 2, and either controlling the moving of the air to adjust its flow rate, or controlling the energy flow to head 2, in further dependence upon the sensed temperature of head 2, to maintain it at a selective elevated temperature above ambient temperature.

Figure 2:
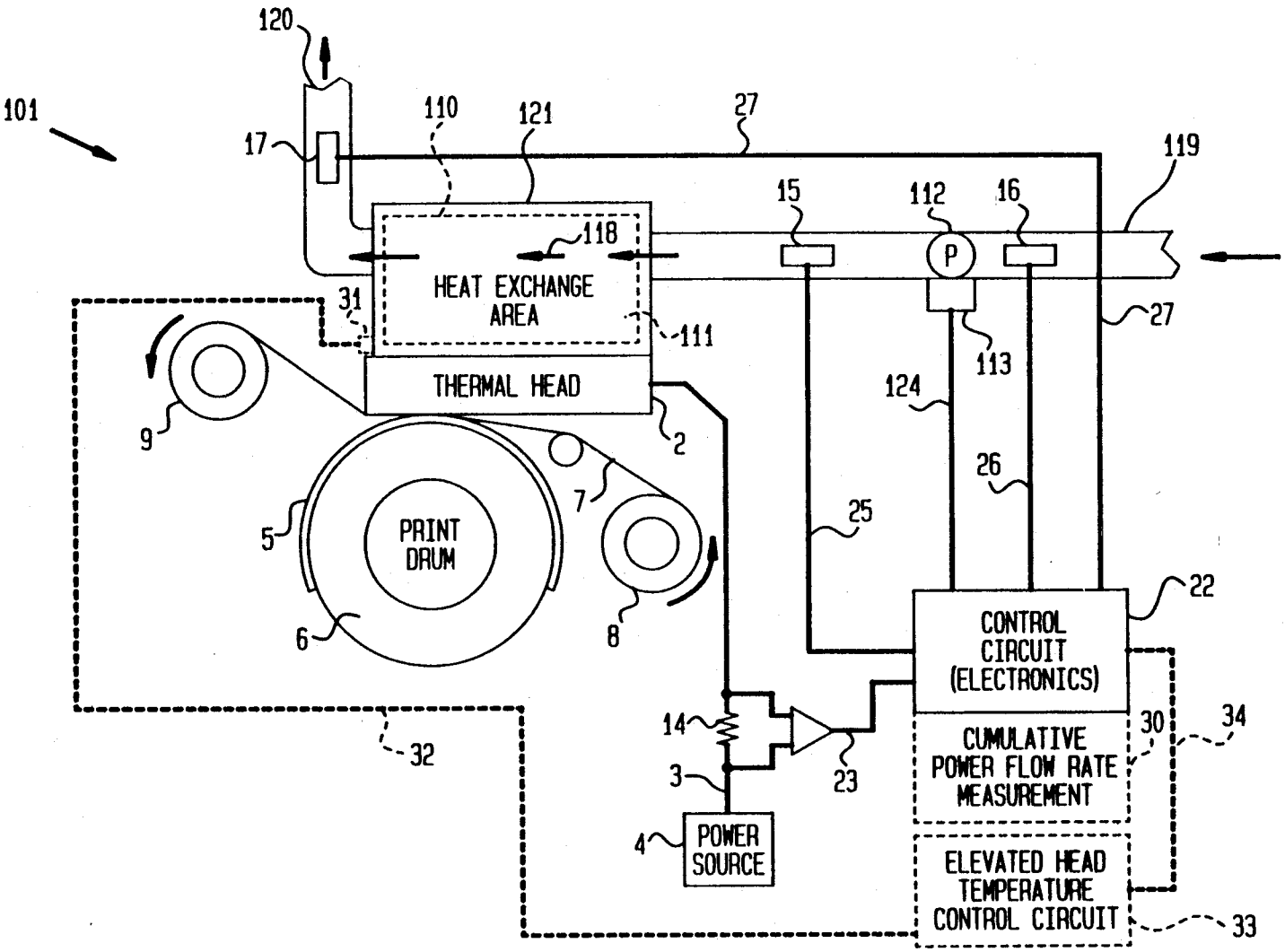
FIG. 2 is a schematic view of a thermal printing device having is-enthalpic control, in accordance with another embodiment of the invention.

Referring now to FIG. 2, there is shown a thermal printing device 101 in accordance with another embodiment of the invention. The thermal printing device 101, which uses a liquid heat transfer medium formed of water as fluid coolant, comprises a thermal printing head 2, a power line 3, a power source 4, a paper sheet 5, a print drum 6, a web carrier 7, donor payout and take-up rolls 8 and 9, a heat transfer area 110, a flow chamber 111, a pump 112, a pump drive or motor 113, a head power sensor 14, a flow sensor 15, temperature sensors 16 and 17, a flow path 118, intake and exhaust regions 119 and 120, a housing 121, control means 22, a head sense line 23, a pump power line 124, a flow sense line 25, intake and exhaust temperature sense lines 26 and 27, a cumulative power flow rate measurement circuit 30, a head temperature sensor 31, an auxiliary head temperature sense line 32, an elevated head temperature control circuit 33, and an auxiliary control line 34.

Device 101 of FIG. 2 is generally equivalent to device 1 of FIG. 1, having the same parts 2–9, 14–17, 22, 23, 25–27 and 30–33, and operating in the same way except in the substitution of a closed fluid flow system for a liquid heat transfer medium involving analogous parts and areas 110–113, 118–121 and 124.

In this case, head 2 is provided with heat transfer area 110, formed as an internal liquid heat exchange area such as a closed flow chamber 111 for travel of cooling water therethrough, e.g., disposed at the back of head 2 remote from its printing elements, to effect transfer of heat generated by head 2 to the water. Area 110 forms a coolable portion on head 2 remote from its printing elements and capable of being cooled by flow contact with the water. Controllable moving means such as pump 112 with conventional pump drive or motor 113 move the water at a controllable flow rate to flow across area 110 to remove the generated heat.

The water is pumped along flow path 118 (indicated by the arrows in FIG. 2) from intake region 119 to exhaust region 120 of housing 121 formed as a flow pipe operatively passing through chamber 111 of area 110. Consequently, flow sensor 15 and intake and exhaust temperature sensors 16 and 17 are disposed within housing 121 for use with head power sensor 14. Sensors 15, 16 and 17 together determine the flow rate of heat energy removed from head 2 by the water flowing across area 110 in path 118 between intake region 119 and exhaust region 120.

Flow sensor 15 is disposed to sense the mass flow rate of the water, e.g., at a point prior to its flow across area 110. Intake temperature sensor 16 is disposed to sense the water temperature prior to its flow across area 110 and exhaust temperature sensor 17 is disposed to sense its temperature after flow across area 110, to determine the change in water temperature between intake region 119 and exhaust region 120. Sensors 14, 15, 16 and 17 operate in the embodiment of FIG. 2 in the same way as in the embodiment of FIG. 1, except that sensors 15, 16 and 17 sense water instead of air.

Control means 22 controls the operation of head 2 and pump 112 in conjunction with head power sensor 14, pump motor 113, flow sensor 15 and temperature sensors 16,17, analogously to the operation described in regard to FIG. 1. Control means 22 is connected to head power sensor 14 by head power sense line 23, to pump motor 113 by pump power line 124, to mass flow sensor 15 by flow sense line 25, and to intake and exhaust temperature sensors 16 and 17 by intake and exhaust temperature sense lines 26 and 27, respectively.

Control means 22 controls the speed of pump 112 by varying the voltage across pump motor 113, in dependence upon the measured flow rate of energy to head 2, and the determined flow rate of energy removed from head 2 by the water, to adjust the water flow rate so that the net energy in head 2 remains substantially constant, in the same way as in FIG. 1. Pump motor 113 is infinitely variable in speed for infinitely varying the water flow rate of pump 112 in corresponding manner to the operation of fan 12 by fan motor 13 in FIG. 1.

The embodiment of FIG. 2 is operated with all of the features as described above for the embodiment of FIG. 1, except in the modification of the system to accommodate a liquid heat transfer medium instead of a gaseous heat transfer medium as cooling fluid.

While water is contemplated as the liquid in the embodiment of FIG. 2, any other suitable liquid may be used such as an organic liquid, e.g., a conventional synthetic cooling liquid. One typical cooling liquid which may be used is that available under the designation "Fluorinert FC-77" from 3M (Minnesota Mining and Manufacturing Co., St. Paul, Minn.).

Since liquids as contemplated herein remain at substantially constant density at the operating temperature of head 2, which is typically maintained at about 120° F. for an ambient temperature ranging from nominally about 70° F. to generally about 85° F., use of a liquid as heat transfer medium lends itself to measuring the liquid mass flow rate in terms of the liquid volume per pump cycle, i.e., by simply measuring the speed of pump 112, in which case flow sensor 15 and flow sense line 25 may be omitted Such pump speed is sensed and controlled by control means 22 in conventional manner in conjunction with pump motor 113 and pump power line 124.

Because liquids have a more constant density than air under the contemplated operating conditions, only the volumetric flow rate need be measured and controlled per this modification. Specifically, as pump 112 delivers a constant volume, and therefore a constant mass, per pump cycle, the pump rate in terms of cycles is controlled so that the heat energy fed to head 2 by power line 3 is balanced by the heat energy removed from head 2 by the liquid.

In regard to all embodiments according to the invention, it is clear that a basic feature is the provision for measuring the power or heat energy into the system and power or heat energy out of the system, for adjusting the cooling fluid flow to achieve is-enthalpic control of the thermal printing head. Indeed, at constant enthalpy (i.e., is-enthalpy) as contemplated herein, there may be different temperatures distributed locally throughout the heat sink as constituted by the printing head, but the average temperature of the printing head always remains constant in accordance with the present invention.

Accordingly, it can be appreciated that the specific embodiments described are merely illustrative of the general principles of the invention Various modifications may be provided consistent with the principles set forth.

What is claimed is:

1. A thermal printing device having is-enthalpic control comprising:

a thermal printing head energizable by a selective flow of electrical energy to generate images on a responsive imaging material;

a heat transfer area associated with said head and disposed to effect transfer of heat generated by said head to a fluid heat transfer medium;

controllable moving means for moving said medium at a controllable flow rate to flow across said area to remove therefrom heat generated by said head;

measuring means for measuring a flow rate of electrical energy to said head;

determining means for determining a flow rate of heat energy removed from said head by said medium that flows across said area; and control means for controlling said moving means, in dependence upon said measured flow rate of electrical energy to said head, and said determined flow rate of heat energy removed from said head by said medium, to adjust said controllable flow rate of said medium so that a net energy in said head remains substantially constant.

2. The device of claim 1 wherein said head has a plurality of elements energizable to generate said images, and said area comprises a coolable portion on said head remote from said elements, for cooling of said coolable portion by flow contact with said medium.

3. The device of claim 1 wherein said determining means comprises:

flow sensing means for sensing a mass flow rate of said medium that flows across said area;

temperature sensing means for sensing a change in temperature of said medium upon flow across said area; and wherein said control means is arranged to control said moving means, in dependence upon said measured flow rate of electrical energy to said head, and said sensed mass flow rate and said sensed change in temperature of said medium, to adjust said mass flow rate of said medium so that said net energy remains substantially constant.

4. The device of claim 3 wherein said temperature sensing means comprises an intake temperature sensor disposed for sensing a first temperature of said medium prior to flowing across said area, and an exhaust temperature sensor disposed for sensing a second temperature of said medium after flowing there across, for sensing said change in temperature.

5. The device of claim 3 wherein said flow sensing means ar disposed for sensing said mass flow rate of said medium at a point prior to flow thereof across said area.

6. The device of claim 3 wherein said flow sensing means comprise mass flow measuring means for measuring a mass per unit time of a gaseous heat transfer medium, and said moving means comprises a fan.

7. The device of claim 3 wherein said flow sensing means comprises mass flow measuring means for measuring a mass per unit time of a liquid heat transfer medium, and said moving means comprises a pump.

8. The device of claim 3 further comprising:

auxiliary measuring means for measuring cumulatively a first energy flow into and a second energy flow being removed form said head over a selective on-going period of time; and wherein said control means is arranged to control said moving means to adjust the flow rate of said medium, in further dependence upon said first measured cumulative energy flow into and said second measured cumulative energy flow being removed from said head, to compensate for temporary imbalances in which said first measured cumulative energy flow into said head exceeds said second measured cumulative energy flow being removed from said head.

9. The device of claim 3 further comprising:

auxiliary temperature sensing means for sensing a temperature of said head; and wherein said control means is arranged to control said moving means to adjust the flow rate of said medium, in further dependence upon the sensed temperature of said head, to maintain said head at a selective elevated temperature above ambient temperature.

10. The device of claim 3 further comprising:

auxiliary temperature sensing means for sensing a temperature of said head; and wherein said control means is arranged to control said measured flow rate of electrical energy to said head, in further dependence upon said sensed temperature of said head, to maintain said head at a selective elevated temperature above ambient temperature.

11. A method of operating a thermal printing device, having a thermal printing head, under is-enthalpic control, the method comprising the steps of:

delivering a selective flow of electrical energy to the thermal printing head of the device to generate images on a responsive imaging material, said head being provided with a heat transfer area associated therewith to effect transfer of heat generated by said head to a fluid heat transfer medium;

moving a flow of said medium across said area to remove therefrom heat generated by said head;

measuring a flow rate of electrical energy to said head;

determining a flow rate of heat energy removed from said head by said medium; and controlling said moving of said flow of said medium, in dependence upon said measured flow rate of electrical energy to said head and said determined flow rate of heat energy removed from said head by said medium, to adjust said flow of said medium so that a net energy in said head remains substantially constant.

12. The method of claim 11 wherein said head has a plurality of elements energized to generate said images, and said area comprises a coolable portion on said head remote from said elements and which is cooled by flow contact with said medium.

13. The method of claim 11 wherein the determining of the flow rate of heat energy removed from said head comprises the steps of:

sensing a mass flow rate of said medium that flows across said area;

sensing a first temperature of said medium prior to flow across said area and a second temperature after flow thereof across said area, and in turn a change in temperature of said medium upon flow across said area; and controlling said moving of said flow of said medium, in dependence upon said measured flow rate of electrical energy to said head, and said sensed mass flow rate and said sensed change in temperature of said medium, to adjust said flow of said medium so that said net energy remains substantially constant.

14. The method of claim 13 wherein the mass flow rate of said medium is sensed at a point prior to flow thereof across said area.

15. The method of claim 13 wherein said medium is a gaseous heat transfer medium.

16. The method of claim 13 wherein said medium is a liquid heat transfer medium.

17. The method of claim 13 further comprising the step of measuring cumulatively a first energy flow into and a second energy flow being removed from said head over a selective on-going period of time, and controlling said moving of said flow of said medium to adjust said flow of said medium, in further dependence upon said first measured cumulative energy flow into and said second measured cumulative energy flow being removed from said head, to compensate for temporary imbalances in which said first measured cumulative energy flow into said head exceeds said second measured cumulative energy flow being removed from said head.

18. The method of claim 13 further comprising the step of sensing a temperature of said head, and controlling said moving of said flow of said medium to adjust the flow rate of said medium, in further dependence upon the sensed temperature of said head, to maintain said head at a selective elevated temperature above ambient temperature.

19. The method of claim 13 further comprising the step of sensing a temperature of said head, and controlling said flow rate of electrical energy to said head, in further dependence upon the sensed temperature of said head, to maintain said head at a selective elevated temperature above ambient temperature.

* * * * *

UNITED STATES PATENT AND TRADEMARK OFFICE

CERTIFICATE OF CORRECTION

PATENT NO. : 5,237,338
DATED : August 17, 1993
INVENTOR(S) : Stanley W. Stephenson

It is certified that error appears in the above-indentified patent and that said Letters Patent is hereby corrected as shown below:

Claim 5, column 13, line 61
Delete "ar" and insert --are--.

Signed and Sealed this

Twenty-ninth Day of March, 1994

Bruce Lehman

*Attest:*

BRUCE LEHMAN

*Attesting Officer*

*Commissioner of Patents and Trademarks*